United States Patent [19]

Meisner et al.

[11] Patent Number: 4,557,606

[45] Date of Patent: Dec. 10, 1985

[54] POWER LINE-OPERATED ELECTRONIC TIME-CLOCK

[75] Inventors: Alfred Meisner; Werner Arnold, both of Nuremberg; Frank Eggebrecht, Altdorf; Hans Grasser, Eckental, all of Fed. Rep. of Germany

[73] Assignee: Diehl GmbH & Co., Fed. Rep. of Germany

[21] Appl. No.: 575,815

[22] Filed: Feb. 1, 1984

[30] Foreign Application Priority Data

Feb. 9, 1983 [DE] Fed. Rep. of Germany ..... 3304386

[51] Int. Cl.[4] ..... G04B 1/00

[52] U.S. Cl. ..... 368/204; 368/203

[58] Field of Search ..... 368/203, 204

[56] References Cited

U.S. PATENT DOCUMENTS

| | | | |
|---|---|---|---|
| 3,922,588 | 11/1975 | Kunzel | 368/203 |
| 3,968,417 | 6/1976 | Dials | 368/204 |
| 4,286,263 | 8/1981 | Lindberg | 368/64 |
| 4,316,273 | 2/1982 | Jetter | 368/250 |
| 4,395,135 | 7/1983 | Frantz | 368/82 |
| 4,460,965 | 7/1984 | Trehn et al. | 368/90 |

FOREIGN PATENT DOCUMENTS

| | | | |
|---|---|---|---|
| 58-45589 | 3/1983 | Japan | 368/203 |

*Primary Examiner*—Bernard Roskoski

*Attorney, Agent, or Firm*—Scully, Scott, Murphy & Presser

[57] ABSTRACT

A power line-operated electronic time-clock including a clock switching circuit, a memory for storage of switching or alarm times, including an input device and a display device, and a power outage-bridging circuit for supplying electrical energy during a power outage to at least the timing components of the clock switching circuit and when required, to the memory storage device. The time-clock includes a monitoring circuit that is interconnected to the memory storage device, and the power outage-bridging circuit for generating a blocking signal in response to the absence of timing data being introduced into the memory device for rendering the power outage-bridging circuit inoperative. Thus, the energy storage device within the power outage circuit will not be drained prior to use or during testing of the clocks. In addition, the monitoring circuit may generate the blocking signal subsequent to a predetermined time interval after a power outage to disconnect the time clocks to prevent drainage of the energy storage device over an extended power shut down.

8 Claims, 3 Drawing Figures

POWER LINE-OPERATED ELECTRONIC TIME-CLOCK

BACKGROUND OF THE INVENTION

1. Field of Invention

The present invention relates to a power line-operated electronic clock or timepiece, preferably a timeswitch with a running reserve, including a clock switching circuit, and, when required, a storage or memory for switching or alarm times, including an input device and a display device, a bridging arrangement for power outages including an energy storage, wherein at least the timing components of the clock switching circuit, and when required of the storage device, can be supplied with electrical energy during a power outage. More particularly, the line-operated electronic clock includes a time meter in its clock switching circuit, which subsequent to an actuation up to the input of a time, assumes a waiting or stand-by position.

2. Discussion of the Prior Art

Electronic timepieces or clocks of this type are presently known in the technology. For example, the Heating Regulator, Type SM, No. M 74023-A1 (Montage- und Bedienungsanleitung, Bestell- No. MWB/C 73000-M 7400- C 15-3) can be obtained from the Siemens AG, West Germany, which incorporates a line-operated electronic timeswitch for the periodic control of the heating regulation. This timeswitch employs batteries as energy storage devices for the bridging of power outages, wherein upon the absence of the power supply voltage, switching is effected by means of a suitable circuit to the energy storage devices; in effect, to the clock switching circuit for the purpose of protecting the data. In particular, this clock incorporates a clock or time switching circuit which assumes a stand-by position subsequent to an actuation (blinking of the display), until a data input has been carried out.

A clock of that type cannot distinguish between an ordinary power outage and a power outage during storage or a stoppage. When the energy storage device is built in during manufacture, by the time the time clock is installed and actuated by an end user, the energy storage is empty; in essence, drained. When non-rechargeable batteries are employed as the energy storage device, they must be replaced which requires an easy accessibility to the batteries. When, in contrast therewith, it is not been ascertained that the battery is discharged, then during the occurrence of power outages, the appliances which are controlled by the clock may be extensively damaged. Similar problems are also encountered with rechargeable energy accumulators in which low discharge phenomena can occur during storage which can render recharging impossible or, at least, considerably delayed.

SUMMARY OF THE INVENTION

Accordingly, it is an object of the present invention that, in a power line-operated electronic clock or timepiece with an energy storage for the bridging of a power outage, there is facilitated the installation of the energy storage during the manufacture of the clock, so that the charge of the energy storage should remain intact even during an extended storage period.

In order to achieve the foregoing object, a power line-operated electronic clock as described hereinabove is equipped with a monitoring circuit which is joined to the memory so that the monitoring circuit can generate a blocking signal at the absence of introduced timing data in the memory, which will actuate the power outage-bridging device in a manner such that the latter or the energy storage will be switched inoperative.

Pursuant to a further embodiment of the invention, in which a time meter is interconnected with the monitoring circuit whereby, through the intermediary of the monitoring circuit there can be generated a blocking signal in the presence of the stand-by position of the time meter, which will so control the power outage-bridging arrangement that the latter, or the energy storage is switched inoperative.

A clock of that type is thus in the position, in accordance with predetermined criteria, to be able to distinguish between a genuine power outage and storage or stoppage. Hereby, it is presumed that an electronic clock, subsequent to its initial activation, must be set by the end user to the correct time. This setting procedure produces an electrical signal which places the power outage-bridging arrangement into readiness so that upon a subsequent power outage, the power outage-bridging circuit arrangement becomes effective. If, in contrast therewith, there is carried out an activation of such a clock without undertaking any setting of the time; for example, when testing after manufacture, then the power outage-bridging arrangement is not switched into a condition of readiness. When the clock is thereafter separated from the power supply, the power outage-bridging arrangement remains inoperative and the charge of the energy storage associated therewith remains intact.

In a timeswitch, timing clock or alarm clock it is also possible to employ the content of the timing memory as a criterium for the switching-on or switching-off of the power outage-bridging arrangement. Through monitoring or sampling of the memory it can be determined as to whether the timing data have been introduced, and for the case when such data are not present, the power outage-bridging arrangement is switched to be inoperative.

For a clock with a special clock switching circuit, which after the initial activation remains in a stand-by position until a time is introduced, it is also possible to monitor the time meter of the clock switching circuit. The power outage-bridging arrangement is then only switched to be operative when the clock switching circuit is no longer in the stand-by position; in essence, at least a first input has been carried out.

In the same manner is it possible to obtain suitable combinations of these three monitoring or test types. Hereby, of particular advantage for time switches is the combination of memory testing and the monitoring of the clock switching circuit in the stand-by position, whereby the two criteria (clock switching circuit not in the stand-by position, stored timing data present) must coincide in order to allow the power outage-bridging arrangement to become operative during a power outage.

A particularly advantageous embodiment of the line-operated electronic clock incorporates an additional control for the power outage-bridging arrangement, which serves to distinguish between a power outage and an arbitrary stoppage over a lengthier time period subsequent to a normal operation. Hereby, it is assumed that an encountered power outage will last for only a limited time, for example, ten hours. Thus, when a power outage continues for a lengthier period, it is assumed that the timepiece inactivated, and the power outage-bridging arrangement is rendered inoperative, for example, after twenty hours. This embodiment is particularly adapted for timeswitches employed for heating control, since these are frequently inactivated during the summer months.

In a particularly simple manner is there effectuated the timed control of the power outage-bridging arrangement with an electronic time meter, which receives a timing pulse from the clock switching circuit. For the generating of a control signal there is preferably utilized an overrun signal of the electronic meter.

In the inventive arrangement it is also readily possible to employ ordinary non-rechargeable batteries as energy storages for the power outage-bridging, which provide for a life-expectancy of from five to ten years and which allow for an operating period for a clock of up to thousands of hours. In particular, these batteries can also be built into the clock since they need not be accessible at all times. Moreover, inasmuch as batteries of that type are considerably less expensive than equivalent energy sources such as NiCd batteries or capacitors with corresponding capacities, a clock of that kind can be produced considerably more economically.

BRIEF DESCRIPTION OF THE DRAWINGS

Reference may now be had to the following detailed description of exemplary embodiment of the invention, taken in conjunction with the accompanying drawings; in which.

DETAILED DESCRIPTION

Figure 1:
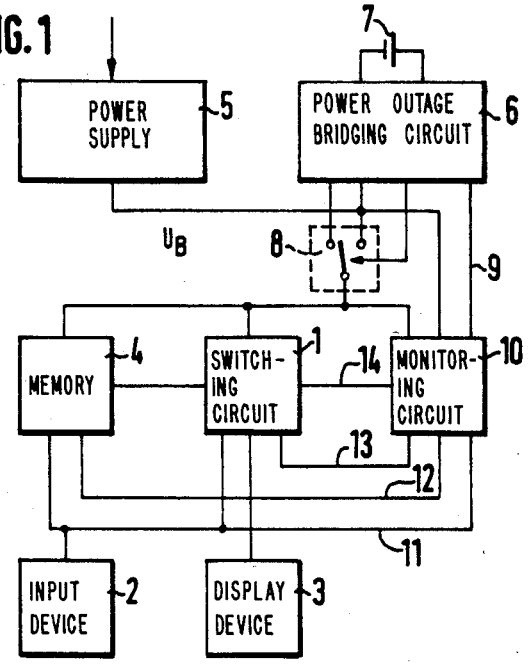
FIG. 1 illustrates a block circuit diagram of a power line-operated clock with a power outage bridging circuit.

In FIG. 1 of the drawings there is illustrated a block circuit diagram of a power line-operated electronic clock or timepiece. This clock consists of a usual clock switching circuit 1 which is interconnected with an input device 2; for example, a pushbutton arrangement, and with a display device 3; for example, an LC-display. Furthermore, the clock switching circuit 1 is connected with a memory 4 in which there can be stored alarm or switching terms or periods, or the like by means of input device 2. In FIG. 1 there is not shown the switching or alarm device which is interconnected with the clock switching circuit 1. A power supply component 5 is provided for supplying current to the clock, and which provides the supply voltages (operating voltage $U_B$ and, when necessary, further voltages for the display device or the like) which are required for the individual components. Furthermore, there is provided a power outage-bridging arrangement 6 with an energy storage 7. For example, employable as energy storages 7 can be NiCd-batteries, capacitors and, preferably, non-rechargeable batteries. At the occurrence of a power failure of the current supply, the power outage-bridging arrangement 6 will switch at least at the time-maintaining circuit portions of the clock, as well as when required, the memory 4, to the energy storage 7 for the duration of the power outage. This is indicated in the block circuit diagram of FIG. 1 by means of a selector switch 8 which is controlled by the power outage-bridging arrangement 6, and which can shunt the current supply between the power supply component 5 and the power outage-bridging arrangement 6. Additionally, the power outage-bridging arrangement 6 is actuated through a blocking signal line 9 from a monitoring or test circuit 10. The monitoring circuit 10 generates a blocking signal during the presence of predetermined criteria, which switches the energy storage 7 or the entire power outage-bridging arrangement 6 inoperative through the blocking signal line 9; in essence, in the event of a power outage, the clock is switched off completely.

As possible criteria for the generation of a blocking signal there can be applied the following three situations:

(a) The input device 2 was not utilized prior to the power outage; in effect, the correct time has not even been set once.

(b) No time period or term data have been introduced into the memory 4; in essence, for example, in a time switch, so that no time programming has taken place prior to the power outage.

(c) The clock switching circuit 1; for example, a time meter which is integrated within the clock switching circuit 1, is in a stand-by position. This stand-by position, which provides for special clock switching circuits, signifies that the time meter, subsequent to an initial activation, will not immediately commence to count the timing pulse, but will wait until it has been set (to the actual time). Clocks of that type with a stand-by position are known (for example, the clock in the above-mentioned Siemens Heating Regulator SM).

In the circuit block diagram pursuant to FIG. 1, the monitoring or test circuit 10 is connected by means of input test lines 11 with the input device 2, through data test lines 12 with the memory 4, and by means of counter test lines 13 with the clock switching circuit 1; meaning, the monitoring circuit 10 can produce a block signal on the basis of all three criteria a, b, and c. However, in an actual exemplary embodiment, as a rule a single criterium, or possibly a combination of two criteria, will be adequate for evaluation through the monitoring circuit 10. Which of the three criterium are selected is dependent upon the type of the clock and upon a type of the testing which as required, is carried out after the manufacture.

The purpose of this monitoring circuit, in every instance, is to be able to distinguish between an ordinary power outage and a storage or stoppage, so as to, for instance, during a storage or stoppage, prevent the emptying or complete depletion of the energy storage 7.

This can be further improved upon when the operating period of the power outage bridging arrangement 6 is limited to a specific time interval during each power outage, which is approximately as large as or larger than the duration of a usual lengthier power outage. When the clock is disconnected from the power supply over a lengthier period of time, for example, a time switch which is used for the control of a heating installation or the like is switched off over the summer, then also the power outage-bridging arrangement or, respectively, the energy storage 7 is switched to be inoperative after a predetermined time interval, so that the remaining charge of the energy storage 7 will remain intact. An arrangement of that type for the timewise limitation of the power outage bridging interval can be constructed as a part of the monitoring circuit 10 whereby, preferably, the clock switching circuit 1 delivers a suitable timing pulse through the pulse line 14 to the monitoring circuit 10.

Figure 2:
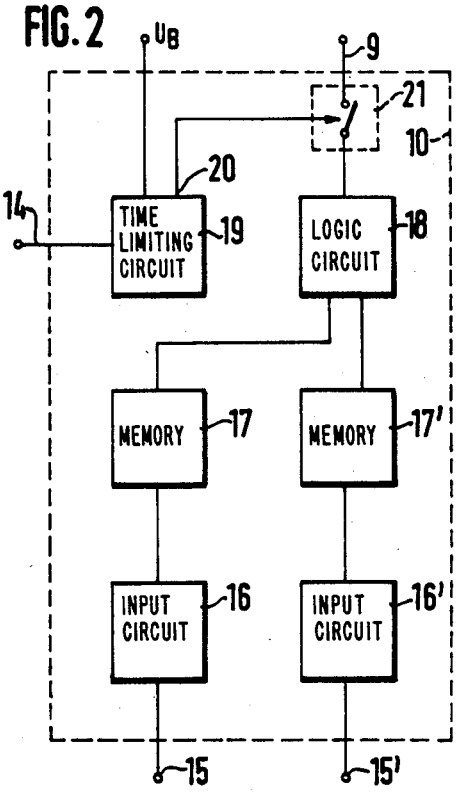
FIG. 2 illustrates a block circuit diagram of a test circuit for the control of the power outage bridging.

Illustrated in FIG. 2 of the drawings is the block circuit diagram of a monitoring or test circuit 10 for two deactivating criteria, and a device for the timewise limitation of the operating period of the power outage-bridging arrangement 6. Illustrated in FIG. 2 is a monitoring circuit 10 with two test inputs 15, 15', to which there can be connected two of the test lines 11, 12, 13 shown in FIG. 1. The monitoring circuit 10 as illustrated herein is accordingly adapted for an evaluation pursuant to two criteria. Connected with the test inputs 15, 15', is, respectively, an input circuit 16, 16', which evaluates the signals present in the test lines 11, 12, 13 (input/no input; memory condition; stand-by position-/operation of the meter), and to correspondingly set a memory 17, 17' or a static flip-flop in conformance with the evaluation results. The output of the memory 17, 17', upon the evaluation of a plurality of criteria, are interconnected through a logic circuit 18. As the logic circuit 18 there can be utilized, for example, AND or OR gates, in accordance as to whether presently one of a plurality of evaluating criteria or all of the evaluating criteria should be required for a release/blocking of the power outage bridging arrangement 6. The output of the logic circuit 18 controls the power outage bridging arrangement 6 through the blocking signal line 9.

Additionally, the monitoring circuit 10 contains a time limiting circuit 19 which, for example, is controlled by means of a suitable time pulse, for instance a single-hour pulse from the clock switching circuit 1 through the pulse line 14. In order to ensure that the time limiting circuit 19 can only commence operation at the beginning of a power outage, it can be permanently reset, for example, by means of the line power supply-dependent operating voltage $U_B$. During a power outage, the operating voltage $U_B$ will break down, and the time limiting circuit 19 commences operation. After the passage of a predetermined time interval, preferably in the range of between 10 and 100 hours, the time limiting circuit 19 produces a further blocking signal at its output 20 which can also switch the power outage-bridging arrangement 6 inoperative. In FIG. 2 of the drawings this is indicated through a controllable switch 21 which is connected in the blocking line 9 at the output of the logic circuit 18. This controllable switch 21 is switched over by the time limiting circuit 19 after the passage of the predetermined time interval subsequent to a power outage, and influences the blocking release signal in such a manner that the power- outage bridging arrangement is switched to be inoperative.

Figure 3:
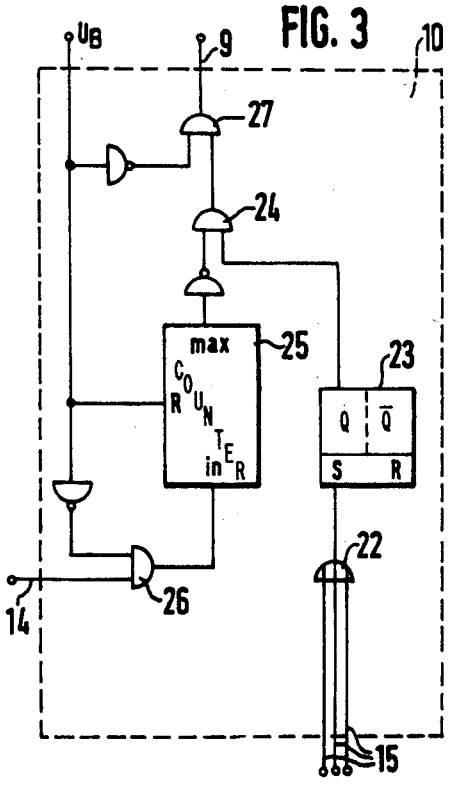
FIG. 3 illustrates a simplified exemplary embodiment of a test circuit for monitoring the input by means of a pushbutton arrangement.

Finally, in FIG. 3 there is represented a simple exemplary embodiment of a monitoring or test circuit 10 which is adapted for a single evaluating criterium, for example, an input through an input pushbutton arrangement with three pushbuttons (not shown). The monitoring circuit 10 pursuant to FIG. 3 incorporates a test input 15 of three lines which can be presently connected with a pushbutton contact. When one of the three pushbuttons of the input pushbutton arrangement is actuated, then a signal appears in one of the three lines of the test input 15, for example, "1". The three lines of the test input 15 are joined through a triple-OR gate 22 and actuate the setting input S of a static flip-flop 23. This flip-flop 23 is set in pursuance to one of the pushbuttons of the input pushbutton arrangement being actuated. The output signal at the output Q of the flip-flop 23 is interconnected through a first AND-gate 24 with the inverted maximum (overflow) signal of a counter 25. This counter 25 is reset with the aid of the line power-dependent operating voltage $U_B$ as long as no power outage occurs. When a power outage is encountered, then the counter is released, and through the pulse line 14 receives a time pulse across a second AND gate 26, which has also been released by means of the inverted line power-dependent operating voltage $U_B$, preferably an hour-pulse. By means of this time pulse, the counter 25, for example, a four-bit counter, counts 15 hours and then produces the maximum (overflow) signal. Additionally, the monitoring circuit 10 can also incorporate a third AND gate 27 which is supplied with the inverted line power-dependent operating voltage $U_B$ and the output signal of the first AND gate 24. Connected to the output of this third AND gate 27 is the blocking signal line 9 through which, as required, the power outage-bridging arrangement 6 or the energy storage 7 is switched to be inoperative.

What is claimed is:

1. In a line-operated electronic time-clock having a clock switching circuit, a memory for storage of input switching or alarm terms, an input means for entering the input terms, a display means for displaying the input terms, and power outage-bridging circuit including an energy storage means for supplying power to at least the clock switching circuit and the memory during a power outage; the improvement comprising:

a monitoring circuit connected to the input means and to the power outage-bridging circuit wherein the monitoring circuit generates a blocking signal in response to the non-actuation of the input means for rendering the power outage-bridging circuit inoperative.

2. In a line-operated electronic time-clock having a clock switching circuit, a memory for storage of input switching or alarm terms, an input means for entering the input terms, a display means for displaying the input terms, and a power outage-bridging circuit including an energy storage means for supplying power to at least the clock switching circuit and the memory during a power outage; the improvement comprising:

a monitoring circuit connected to the memory and to the power outage-bridging circuit wherein the monitoring circuit generates a blocking signal in the absence of term data being stored in the memory for rendering the power outage-bridging circuit inoperative.

3. In a line-operated electronic time-clock having a clock switching circuit including a time meter which upon an actuation of the clock assumes a stand-by position until the input of term data, a memory for storage of switching or alarm terms including an input means and a display means, and a power outage-bridging circuit including an energy storage means for supplying power to at least the clock switching circuit and the memory during a power outage; the improvement comprising:

a monitoring circuit being connected to the time meter and to the power outage-bridging circuit wherein said monitoring circuit generates a blocking signal in response to the stand-by condition of the time meter for rendering the power outage-bridging circuit inoperative.

4. Line-operated electronic clock as claimed in claim 3, wherein said blocking signal is generated by said monitoring circuit upon an actuation of the input means or upon the input of data into the memory or in the absence of the stand-by position of the time meter subsequent to a predetermined time interval after a power outage.

5. Line-operated electronic clock as claimed in claim 4, wherein the monitoring circuit includes an electronic counter which is suppliable with a timing pulse from the clock switching circuit at the beginning of a power outage, said blocking signal being generated by said monitoring circuit upon the reaching of a predetermined count condition.

6. The line-operated electronic clock as claimed in claim 1 wherein the blocking signal renders the energy storage means inoperative.

7. The line-operated electronic clock as claimed in claim 2 wherein the blocking signal renders the energy storage means inoperative.

8. The line-operated electronic clock as claimed in claim 3 wherein the blocking signal renders the energy storage means inoperative.

* * * * *